United States Patent [19]

Wu

[11] Patent Number: 4,717,032

[45] Date of Patent: Jan. 5, 1988

[54] BOTTLE WITH SELF-CONTAINED PICKUP TOOL

[76] Inventor: Chyi-Yiing Wu, P.O. Box 10160, Taipei, Taiwan

[21] Appl. No.: 16,186

[22] Filed: Feb. 17, 1987

[51] Int. Cl.[4] ..... B65D 51/24

[52] U.S. Cl. ..... 215/228; 215/DIG. 5; 220/85 D

[58] Field of Search ..... 215/229, 1 A, 228, DIG. 5; 220/90.2, 85 D

[56] References Cited

U.S. PATENT DOCUMENTS

| | | | |
|---|---|---|---|
| 2,066,121 | 12/1936 | Morris | 215/229 |
| 2,175,735 | 10/1939 | Banks | 215/228 UX |
| 2,627,276 | 2/1953 | Eggleton | 220/85 D X |

*Primary Examiner*—Donald F. Norton

[57] ABSTRACT

A bottle includes a bottle body having a top cover sealing a bottle neck of the bottle body, and a detachable tool chosen from a spoon, a fork, a brush or the like resiliently held in a tool holder fixed under the top cover, so that the tool is always held within the bottle ready for pickup service to pick up seasoning or preserving material filled inside the bottle for convenient and hygienic uses.

5 Claims, 5 Drawing Figures

BOTTLE WITH SELF-CONTAINED PICKUP TOOL

BACKGROUND OF THE INVENTION

A conventional seasoning bottle or preserving bottle is filled with seasoning or preserving materials for cooking or eating purpose, in which a spoon should be further provided to pick up the seasoning or preserving powder or liquid as stored in the bottle to cause inconvenience for an user.

Conventional caster, for example, filled with pepper powder, is always formed with plural perforations drilled on a top cover or a bottle bottom for discharging the pepper powder by decanting or by vibrating such caster bottle, to thereby have the following defects:

1. The perforations formed on the bottle may be easily penetrated by moisture, dust or other pollutants to contaminate the inside seasoning or to wet the powder seasoning to deteriorate its quality, harmful for human health.

2. The pickup quantity is difficultly controlled since the perforation can be clogged by inside seasoning, especially when the seasoning powder is agglomerated as absorbing moisture through such perforations.

The present inventor has found the defects of a conventional seasoning bottle and invented the present bottle with self-contained pickup tool.

SUMMARY OF THE INVENTION

The object of the present invention is to provide a bottle including a bottle body for filling seasoning or preserving materials, a pickup tool resiliently held under cover of the bottle to poke into the bottle body, and a tool holder formed under the cover for securing the tool for the pickup of seasoning inside the bottle for convenient hygienic use.

DETAILED DESCRIPTION

Figure 1:
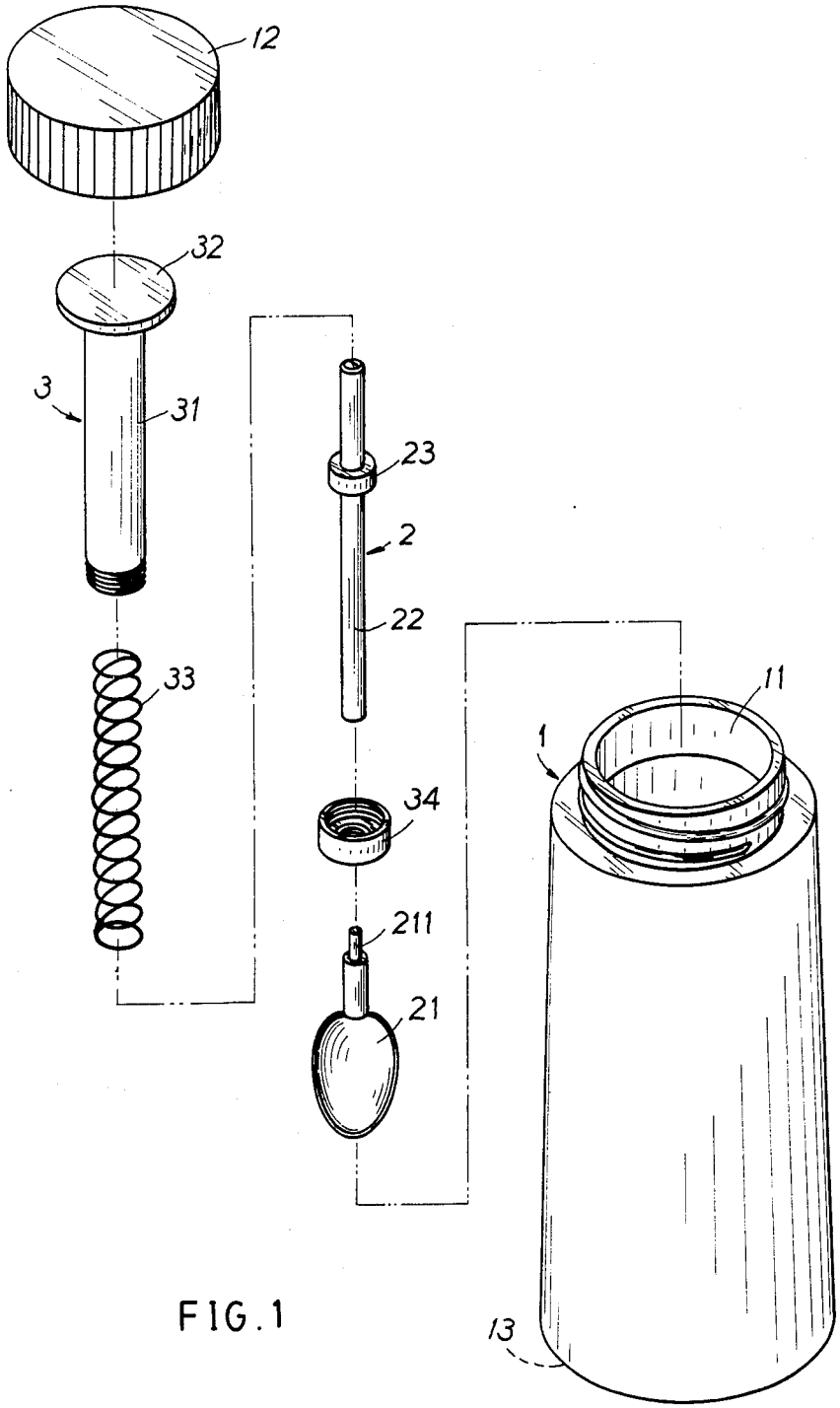
FIG. 1 is a perspective view of the present invention as disassembled.
Figure 2:
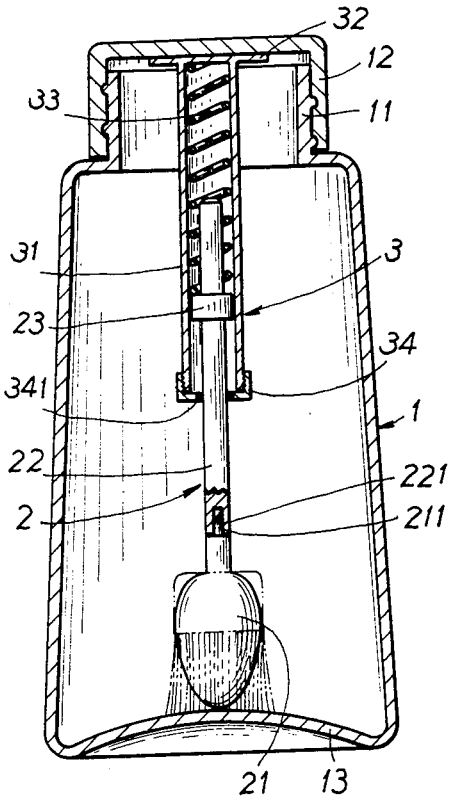
FIG. 2 is a sectional drawing of the present invention when assembled.

As shown in FIGS. 1 and 2, the present invention comprises: a bottle body 1, a pickup tool 2 and a tool holder 3.

The bottle body 1 includes a bottle neck 11 operatively sealed by a top cover 12 and a bottle portion 13, adapted for filling seasoning or preserving materials inside the bottle body 1.

The pickup tool 2 includes: a detachable tool 21 selectively made as a spoon, a fork, a brush or the like having an upper pin 211 formed on its upper end, a tool rod 22 having a pin hole 211 formed on its lower end to engage with the upper pin 211 of the detachable tool 21, and a plunger 23 formed on the upper portion of rod 22.

The tool holder 3 includes a longitudinal cylinder 31 having a top flange 32 fixed under the top cover 12, a restoring spring 33 inserted in the cylinder 31 to resiliently retain the plunger 23 of the tool 2 within the cylinder 31 to resiliently depress the rod 22 downwards to normally poke the tool 21 onto the bottom 13 and a bottom cap 34 formed on the lower end of the cylinder 31 to limit the downward movement of the plunger 23 of the tool 2. A packing ring 341 is formed on the central portion of the cap 34 to reciprocatively seal the rod 22 of tool 2 passing through the ring 341 of cap 34. The top flange 32 is fixed under the top cover 12 by adhesive or high-frequency welding or other mechanical methods well known by those skilled in the art.

Figure 4:
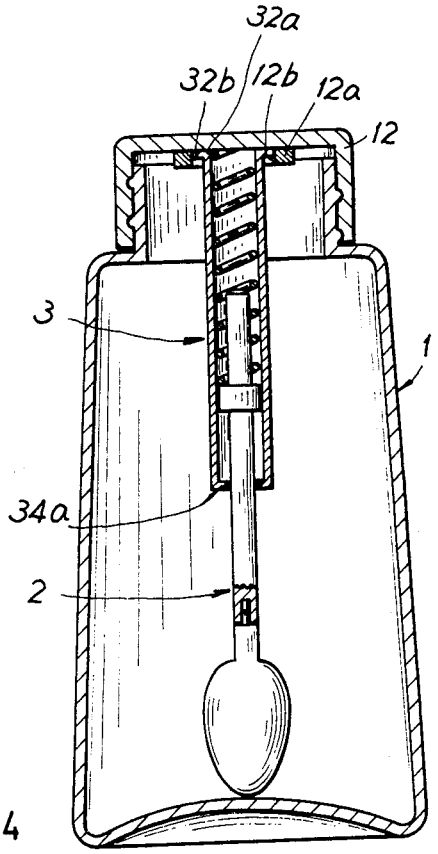
FIG. 4 is a sectional drawing of the present invention when assembled from the elements as shown in FIG. 3.
Figure 3:
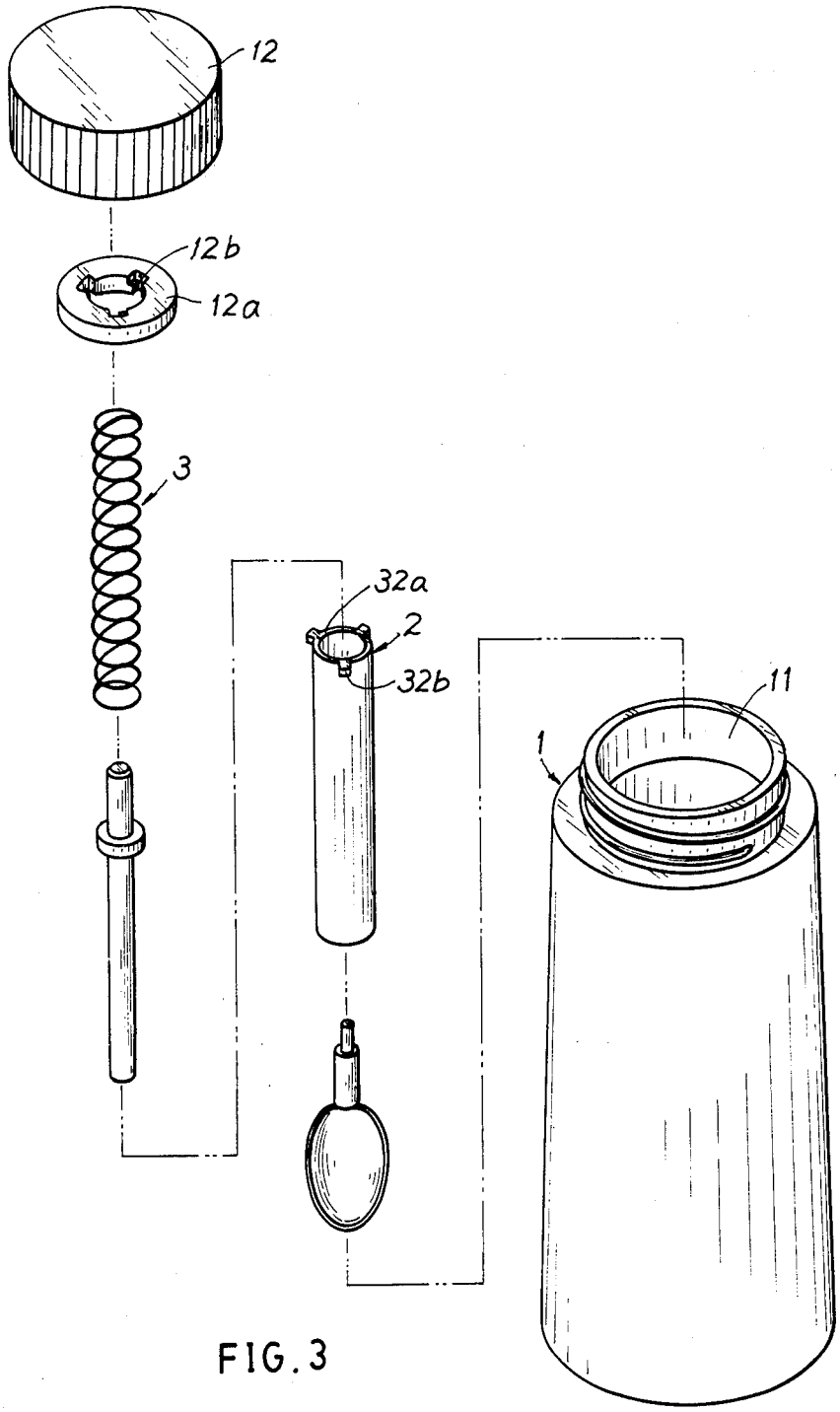
FIG. 3 is a perspective view of the other preferred embodiment of the present invention when disassembled.

The other preferred embodiment of the present invention is shown in FIGS. 3 and 4 in which the top flange **32*a* of the tool holder 3 is formed with three pawls 32*b* extending from the perimeter of the flange 32*a* and a socket 12*a* formed under the top cover 12 is formed with three recesses 12*b* each operatively engaged with each pawl 32*b* so that the top flange 32*a* of the holder 3 can be rotatably fixed into the socket 12*a* of the top cover 12 and finally locked in the socket 12*a* for stable service of the holder 3 and the tool 2 held in the holder 3**.

When using the present invention, the cover 12 is opened and the tool 2 such as a spoon is shown in full line or a brush as shown in dotted line of FIG. 2 can be operated by holding the cover 12 to pick up the seasoning or preserving materials stored in the bottle body, for seasoning or eating purpose. Naturally, other materials such as medical powder, syrup, paste, etc. can also be picked up in accordance with the present invention for quantitative dosage uses. The detachable tool 21 may be chosen from: a spoon, a fork, a brush, a needle, a knife, a pipe, a straw or other device suitable for the pickup of a liquid, powder, solid, colloid or other shapes of materials, which are not limited in the present invention.

In FIG. 3, the lower end of longitudinal cylinder 31 is formed as a closed cap **34*a* having a central hole for inserting such packing ring 341 to thereby omit the releasable cap 34 as shown in FIG. 1 to save production cost and increase the assembly convenience. Other mounting methods for fixing the cylinder 31 under the top cover 12 can be utilized in the present invention, not only being limited to the ways as shown in FIGS. 1 and 3**.

When the materials inside the bottle is almost used up, the tool 21 as restored downwards by the spring 33 will be protruded outwards, available to poke into "dead-corners" on the bottle bottom 13 for thoroughly picking up the residual materials especially accumulated on the corners.

Accordingly, this invention has the following advantages and characteristic features:

1. The tool 21 is resiliently held in situ within the bottle to be ready for pickup service for convenient uses of the materials filled inside the bottle. 2. The detachable tool 21 can be substituted with other tools for diversified applications of the present invention. Also, once the tool is out of order it can be replaced with the new one as dismantled from the lower end of the rod 22. 3. The tool 21 is always held within the bottle under the closed top cover 12 for dust-proof and for preventing any contamination or wetting defects as always found in a conventional caster having perforations thereon.

Figure 5:
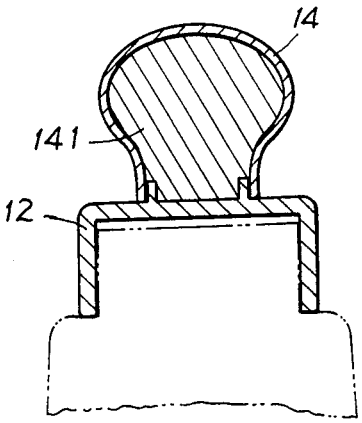
FIG. 5 shows another top cover in accordance with the present invention.

The top cover 12 as shown in FIG. 5 can be further formed with a top knob 14 filled with heavy material 141 inside the knob 14 to gravitationally force the cover 12 sealing the bottle body 1, against the upward resilient force of the spring 33.

What is claimed is:

1. A bottle with self-contained pickup tool compising:

a bottle body having a bottle neck operatively sealed by a top cover fixed thereon, said bottle adapted for filling with seasoning, preserving or medical materials therein;

a detachable pickup tool having a detachable tool detachably fixed under a tool rod having a plunger formed on the upper portion of the rod; and a tool holder including a longitudinal cylinder having a top flange fixed under said top cover of said bottle body, a restoring spring inserted in said cylinder to resiliently retain said plunger of said rod to protrude said tool downwards, and a bottom cap fixed on the lower end of said cylinder having a packing ring formed therein for reciprocatively passing said tool rod therethrough, said detachable tool resiliently depressed downwards to normally poke onto a bottom portion of said bottle body.

2. A bottle according to claim 1, wherein said detachable tool is either a spoon, a fork, a brush, a needle, or a knife.

3. A bottle according to claim 1, wherein said top flange of said longitudinal cylinder of said tool holder is fixed under the top cover by adhesive or by high-frequency welding.

4. A bottle according to claim 1, wherein said top flange of said tool holder is formed with three pawls from the flange perimeter, and a socket having three recesses each engaged with each said pawl, said socket being under said top cover, whereby upon the engagement of said pawls into said recesses of said socket, said tool holder is fixed under said top cover of said bottle body.

5. A bottle according to claim 1, wherein a top knob filtered with heavy materials is formed on the top cover to gravitationally force said top cover sealing said bottle body, against the upward resilient force of said spring inside said cylinder.

* * * * *